United States Patent [19]

Theodore et al.

[11] 4,314,900

[45] Feb. 9, 1982

[54] METHOD FOR PRODUCING DISTILLABLE HYDROCARBONACEOUS FUELS AND CARBONACEOUS AGGLOMERATES FROM A HEAVY CRUDE OIL

[75] Inventors: Frank W. Theodore, Pittsburgh; George E. Wasson, Eighty Four, both of Pa.

[73] Assignee: Conoco Inc., Stamford, Conn.

[21] Appl. No.: 147,454

[22] Filed: May 7, 1980

[51] Int. Cl.[3] ..... C10G 9/32

[52] U.S. Cl. ..... 208/126; 208/106; 48/211

[58] Field of Search ..... 208/126, 106, 176; 48/211

[56] References Cited

U.S. PATENT DOCUMENTS

| | | | |
|---|---|---|---|
| 2,844,521 | 7/1958 | Jahnig | 208/126 |
| 2,855,361 | 10/1958 | Schutte | 208/126 |
| 2,905,595 | 9/1959 | Berg | 208/176 |
| 2,910,427 | 10/1959 | Cabbage | 208/126 |
| 3,401,089 | 9/1968 | Friedrich et al. | 201/6 |
| 4,180,455 | 12/1979 | Taciuk | 208/126 |

*Primary Examiner*—Delbert E. Gantz
*Assistant Examiner*—Olik Chaudhuri
*Attorney, Agent, or Firm*—Dale Lovercheck; William A. Mikesell, Jr.; F. Lindsey Scott

[57] ABSTRACT

A method for producing a distillable hydrocarbonaceous stream and carbonaceous agglomerates from a heavy crude oil by charging the crude oil and finely divided carbonaceous solids to a rotary kiln with the crude oil and carbonaceous solids being charged in a weight ratio from about 0.6 to about 1.5; tumbling the crude oil and finely divided carbonaceous solids in the rotary kiln at a temperature from about 850° to about 1000° F. for up to about 30 minutes to produce a vaporous stream and agglomerate particles containing a residual portion of the crude oil and finely divided carbonaceous solids; separating the agglomerate particles into a product portion of a desired particle size range and a recycle portion; grinding the recycle portion to produce the finely divided carbonaceous solids and heating the finely divided carbonaceous solids prior to recycling the carbonaceous solids to mixture with the crude oil.

8 Claims, 1 Drawing Figure

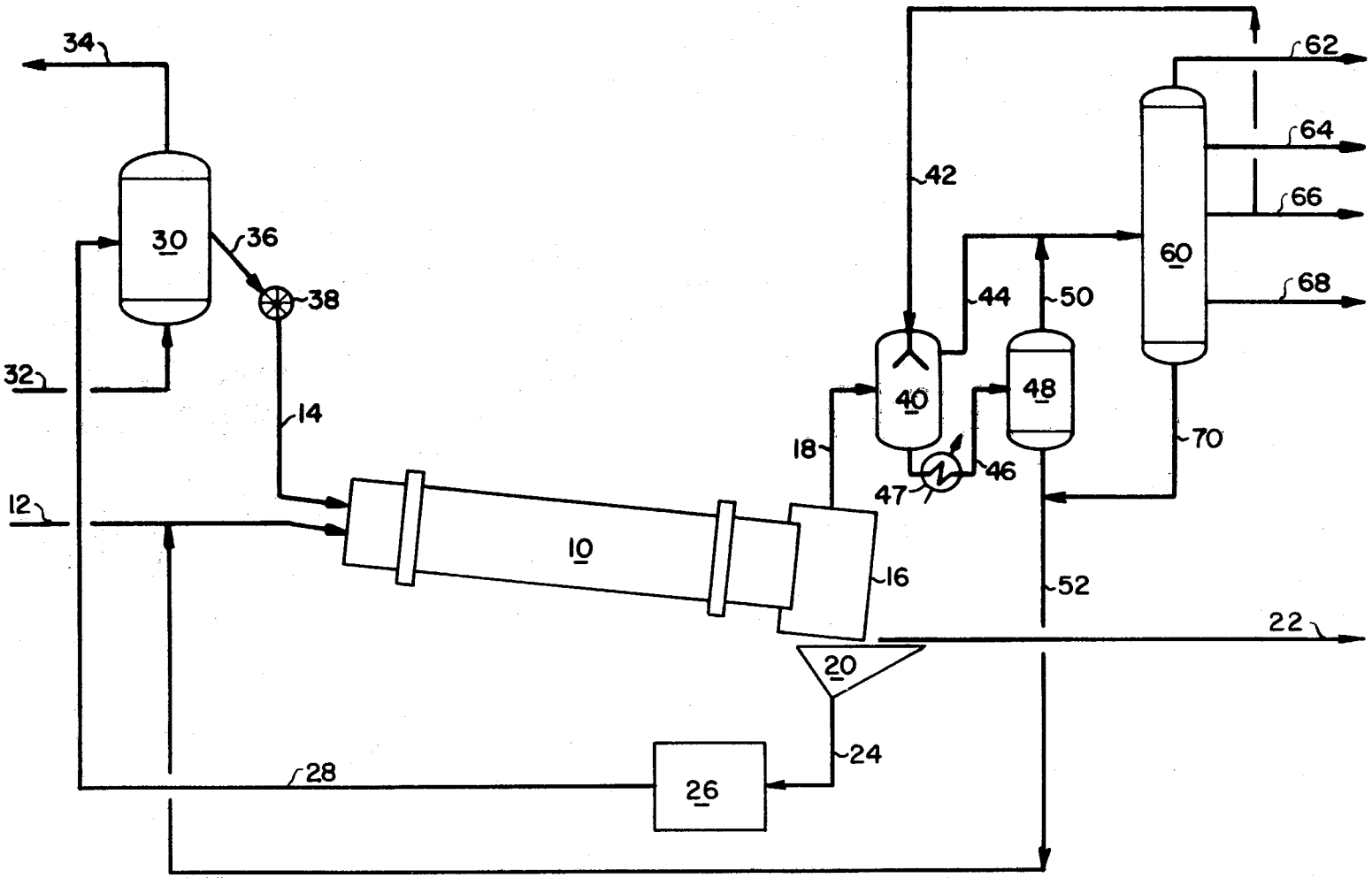
62
64
66
68
60
70
22
50
48
52
44
46
42
40
47
16
20
24
18
26
10
28
38
14
36
30
34
32
12

METHOD FOR PRODUCING DISTILLABLE HYDROCARBONACEOUS FUELS AND CARBONACEOUS AGGLOMERATES FROM A HEAVY CRUDE OIL

This invention relates to methods for producing distillable fuels and agglomerate solids from heavy crude oils.

In view of the recent well publicized shortage of crude oils worldwide and the continuing demand for distillable fuel products, a continuing search has been underway for some time into alternate sources for distillable fuels. One such source which is readily available, is heavy hydrocarbonaceous material such as that present in tar sands, shale oil, heavy crude oil field deposits and the like hereinafter referred to as heavy crude oil. Previously such heavy crude oils have not been widely used as a feedstock to processes for producing distillable fuels since they are difficult to process and result in the production of substantial quantities of residual materials which tend to coke. While some such crude oils have been processed using existing refinery technology, many such crude oils are so heavy and so high in sulfur and heavy metals that they have not been used as refinery feedstocks. Limited use has been made of such oils in some instances as a feedstock to delayed coking operations and the like.

The following patents were considered in the preparation of this application: U.S. Pat. Nos. 2,561,334 issued July 24, 1951 to Bowles et al.; 2,575,587 issued Nov. 20, 1951 to Davies; 2,824,047 issued Feb. 18, 1958 to Gorin et al.; 2,843,533 issued July 15, 1958 to Smith et al.; 2,916,432 issued Dec. 8, 1959 to McNamara; 3,073,751 issued Jan. 15, 1963 to Gorin et al.; 3,077,439 issued Feb. 12, 1963 to Shea et al.; 3,401,089 issued Sept. 10, 1968 to Friedrich et al.; 3,427,240 issued Feb. 11, 1969 to Landrum et al.; 3,562,783 issued Feb. 9, 1971 to Gorin; 3,565,766 issued Feb. 23, 1971 to Eddinger et al.; 3,671,401 issued June 20, 1972 to Gorin; 3,770,418 issued Nov. 6, 1973 to Wilde; 3,803,023 issued Apr. 9, 1974 to Hamner; 3,873,427 issued Mar. 25, 1975 to Long et al.; 4,008,054 issued Feb. 15, 1977 to Clancey et al.; 4,030,982 issued June 21, 1977 to Gorin et al.; 4,039,319 issued Aug. 2, 1977 to Schapiro et al.; Canadian Pat. 880,884 issued Sept. 14, 1971 to Masologites et al.; British Pat. 1,310,735 published Mar. 21, 1973 to Hydrocarbon Research Inc.

As a result of the increasing price of crude oil and the continuing demand for distillable fuels, the search continues for methods for converting such heavy crude oils into distillable products.

It has now been found that such heavy crude oils are readily converted into distillable products and metallurgical grade coke or gasifier feedstock by a method which consists essentially of charging the crude oil and finely divided carbonaceous solids to a rotary kiln with the crude oil and finely divided carbonaceous solids being charged to the rotary kiln in a weight ratio of crude oil to carbonaceous solids from about 0.6 to about 1.5; tumbling the crude oil and the finely divided carbonaceous solids in the rotary kiln at a temperature from about 850° to about 1000° F. (about 450° to about 540° C.) for up to about 30 minutes to produce a vaporous stream and agglomerate particles containing a residual portion of the crude oil and finely divided carbonaceous solids; separating the agglomerate particles into a product portion of a desired particle size range and a recycle portion; grinding the recycle portion to produce finely divided carbonaceous solids and heating the finely divided carbonaceous solids and optionally the crude oil to a temperature sufficient to result in a temperature from about 850° to about 1000° F. (about 450° to about 540° C.) in the rotary kiln upon mixing the finely divided solids and the crude oil.

The FIGURE is a schematic diagram of an embodiment of the process of the present invention.

In the FIGURE, a crude oil stream and a finely divided carbonaceous solid stream are charged to a rotary kiln 10 through a line 12 and a line 14 respectively. The blend of crude oil and finely divided carbonaceous solids which are hereinafter referred to as char are tumbled in rotary kiln 10 for up to about 30 minutes at a temperature from about 850° to about 1000° F. (about 450° to about 540° C.). As a result of the tumbling in rotary kiln 10, agglomerate particles are produced and recovered from the discharge end of rotary kiln 10 on a screen 20. Rotary kiln 10 is desirably sealed and operates at a slight positive pressure so that the atmosphere in rotary kiln 10 is non-oxidizing. A seal 16 is shown about the discharge end of rotary kiln 10 to prevent the escape of vapors therefrom. A vaporous stream is recovered from the discharge end of rotary kiln 10 through a line 18 and passed to further processing as will be discussed further hereinafter. The agglomerate particles consisting of a residual portion of the crude oil and finely divided char are recovered on screen 20 and separated into a portion of a desired size range which is recoverd through a line 22 and constitutes a solids product stream of the process and an undersize or recycle portion which is recovered through a line 24 and passed to a grinder 26. The undersize portion is ground to a desired size in grinder 26 and passed through a line 28 to a fluidized bed heater 30. The undersize portion is typically ground to a size less than about 8 Tyler mesh since it has been found that it is necessary to charge finely divided carbonaceous solids to rotary kiln 10 in order to obtain strong agglomerates in rotary kiln 10 as discussed in U.S. Pat. No. 3,401,089. In heater 30 a fluidized bed is maintained by the injection of a free oxygen containing gas such as air to maintain the fluidized bed in a fluidized condition. The amount of oxygen injected is controlled to provide a desired temperature in fluidized bed 30 with the resulting combustion gases being recovered through a line 34 and passed to cleanup and discharge as flue gas. Optionally the char may be at least partially desulfurized in heater 30 by means known to the art. Finely divided char is withdrawn from heater 30 through a line 36 and passed through a feeder 38 at a desired rate into line 14 as a charge stream to rotary kiln 10. Crude oil and finely divided char are passed to rotary kiln 10 in a weight ratio of crude oil to char of about 0.6 to about 1.5. Considerable variation in the proportions of crude oil and char is possible depending upon the particular crude oil used and the possible presence of diluents in the crude oil to facilitate handling. The crude oil should be charged in proportions such that from about 15 to about 40 weight percent and preferably from about 25 to about 35 weight percent of the agglomerate particles produced consists of residual portions of the crude oil. Such is desirable to ensure proper binding of the finely divided char to produce the agglomerates. Desirably a major portion of the heat required to maintain the desired temperature in kiln 10 is supplied via the char stream although the crude oil can be charged to kiln 10 at an elevated temperature.

The blend of finely divided char and crude oil in rotary kiln 10, as indicated previously, should be at a temperature from about 850° to about 1000° F. (from about 450° to about 540° C.). The temperature in rotary kiln 10 is accomplished by properly adusting the temperature of the stream of crude oil and the stream of finely divided char charged to rotary kiln 10. The char is desirably heated to a temperature from about 1100° to about 1300° F. (from about 595° to about 650° C.) in heater 30 although higher temperatures may be used if necessary to maintain the desired temperature in kiln 10. When metallurgical grade coke is produced, the solids stream recovered through line 22 is desirably of a size range from about ¾ inch to about 3 inches. It may be necessary to calcine the agglomerates to meet metallurgical coke users requirements. When the product stream produced through line 22 is to be used as a feedstock to a gasifier or the like, a size larger than about ¼ inch is suitable.

Typically, from about 60 to about 80 weight percent of the crude oil charged to rotary kiln 10 is recovered as a vaporous stream which typically comprises fuel gases and distillable fuels. The stream is normally recovered from rotary kiln 10 at a temperature from about 850° to about 1000° F. (about 450° to about 540° C.) and passed as a vapor to further processing. As will be apparent to those skilled in the art, the agglomerate particles recovered from rotary kiln 10 at the operating temperatures stated are carbonized. The vaporous stream recovered from rotary kiln 10 through line 18 is passed to a vessel 40 where it is countercurrently contacted with an oil stream charged to vessel 40 through a line 42. The oil is desirably sprayed into vessel 40 with the vaporous stream from line 18 countercurrently contacting the oil spray. The vaporous stream is cooled in vessel 40 and a major portion of any entrained solids in the vaporous stream is removed and recovered through a line 46 which passes the liquid stream recovered from vessel 40 through a heater 47 and to a flash vessel 48 where volatile constituents of the stream flowing through line 46 are flashed through a line 50 to further processing. The bottoms stream recovered from vessel 48 which contains the heavier constituents contained in the vaporous stream recovered from rotary kiln 10 and any entrained solids recovered in vessel 40 is optionally recycled through a line 52 to combination with the crude oil charged to rotary kiln 10. The vaporous stream recovered from vessel 40 through a line 44 and the vaporous stream recovered from vessel 48 through line 50 are combined and passed to further processing in a fractionator 60. In fractionator 60 the vaporous stream is separated into a plurality of hydrocarbon fuels streams recovered through lines 62, 64, 66 and 68. Clearly a variety of streams can be recovered or the vaporous stream can be passed in its entirety to further refining. Optionally, a portion of one of the streams recovered from fractionator 60, shown as a portion of the fraction recovered through line 66, is passed to vessel 40 for use in countercurrently contacting the vaporous stream from line 18. Further, a bottoms portion may be recovered from fractionator 60 which will contain heavy constituents of the vaporous stream recovered through line 18 and may contain a minor portion of finely divided solid materials. The recovery of such a stream is shown through a line 70 with the stream recovered through line 70 being recycled to combination with the crude oil charged to rotary kiln 10. Clearly, a variety of options are available to those skilled in the art for the treatment of the vaporous stream recovered through line 18 to produce a variety of distillable and gaseous hydrocarbon fuels. The processing of such a stream is not considered to be a part of the present invention since the present invention is directed to the production of a distillable stream which is readily processed to yield gaseous and distillable hydrocarbon fuels from a heavy crude oil rather than the refinery techniques used to process the vaporous stream recovered through line 18 into the desired products.

In the practice of the present invention, the heating of the crude oil may be accomplished by means known to those skilled in the art for the heating of such streams. Such techniques are considered to be known to the art and need not be discussed in detail. Similarly the use of an oil spray in vessel 40 while suitably conducted at a temperature from about 300° to about 400° F. (150° to about 205° C.) may be conducted at different temperatures. Similarly a reduced pressure could be used to facilitate the recovery of the volatile constituents of the stream in line 46 in flash vessel 48 although such would require the use of a compressor or the like in line 50. Such variations and modifications are considered to be known to those skilled in the art. Further, in the operation of rotary kiln 10, while residence times of up to about 30 minutes are considered to be suitable it is clear that residence times considerably less than 30 minutes and typically from about 10 to about 25 minutes may be suitable in many instances. For instance at the higher temperatures shorter residence times are required. The primary requisite in rotary kiln 10 is that a suitable time be provided to permit the agglomeration of the finely divided carbonaceous solids with the residual portions of the crude oil to produce agglomerates which thereafter carbonize with the crude oil being thermally cracked to produce vaporous constituents which are recovered through line 18. The selection of a suitable residence time is clearly within the skill of those in the art based upon the feedstreams used.

While the vaporous stream is recovered from the discharge end of kiln 10 in the FIGURE, the vaporous stream can be recovered from either end of kiln 10 or from the middle portions of kiln 10 as shown for instance in U.S. patent application Ser. No. 030,667, filed Apr. 16, 1979 and indicated allowable Feb. 14, 1980. The recovery of the vaporous stream from the middle section of kiln 10 may be preferred when a high percentage of the crude oil is recovered as a vapor from kiln 10.

Having thus described the invention by reference to certain of its preferred embodiments, it is respectfully pointed out that the embodiments described are illustrative rather than limiting in nature and that many variations and modifications are possible within the scope of the present invention. Such variations and modifications may appear obvious or desirable to those skilled in the art based upon the foregoing description of preferred embodiments.

Having thus described the invention, we claim:

1. A method for producing fuel gases, a distillable hydrocarbonaceous stream and carbonaceous agglomerates from a heavy crude oil feedstock, said method consisting essentially of (a) charging said crude oil and finely divided carbonaceous solids to a rotary kiln, said crude oil and said finely divided carbonaceous solids being charged in a weight ratio of crude oil to carbonaceous solids from about 0.6 to about 1.50;

(b) tumbling said crude oil and said finely divided carbonaceous solids in said rotary kiln at a temperature from about 850° to about 1000° F. (about 450° to about 540° C.) for a residence time up to about 30 minutes to produce a vaporous stream and agglomerate particles containing a residual portion of said crude oil and said finely divided carbonaceous solids;

(c) separating said agglomerate particles into a product portion having a desired particle size and a recycle portion;

(d) grinding said recycle portion to produce said finely divided carbonaceous solids;

(e) providing a fluidized bed heating means;

(f) heating said finely divided carbonaceous solids in said fluidized bed heating means to a temperature sufficient to result in a temperature from about 850° to about 1000° F. (about 450° to about 540° C.) in said rotary kiln upon mixing said finely divided carbonaceous solids and said crude oil;

(g) mixing said finely divided carbonaceous solids and said crude oil feedstock, said finely divided carbonaceous solids having been separated as agglomerate particles into a recycle portion and ground into finely divided carbonaceous solids and heated prior to being mixed with said heavy crude oil feedstock.

2. The method of claim 1 wherein said crude oil is charged to said rotary kiln at an elevated temperature.

3. The method of claim 1 wherein product portion of said agglomerate particles is of a size consist from about $\frac{3}{4}$ inch to about 3 inches and is suitable for use as metallurgical grade coke.

4. The method of claim 1 wherein said product portion of said agglomerate particles is of a size consist greater than about $\frac{1}{4}$ inch and is suitable as a gasifier feedstock.

5. The method of claim 1 wherein said agglomerate particles contain from about 25 to about 35 weight percent residual portions of said crude oil.

6. The method of claim 1 wherein said vaporous stream is passed to further processing to produce fuel gases and distillable fuels.

7. The method of claim 1 wherein said residence time is from about 10 to about 25 minutes.

8. A method for producing fuel gases, a distillable hydrocarbonaceous stream and carbonaceous agglomerates from a heavy crude oil feedstock, said method consisting essentially of (a) charging said crude oil and finely divided carbonaceous solids to a rotary kiln, said crude oil and said finely divided carbonaceous solids being charged in a weight ratio of crude oil to carbonaceous solids from about 0.6 to about 1.50;

(b) tumbling said crude oil and said finely divided carbonaceous solids in said rotary kiln at a temperature from about 850° to about 1000° F. (about 450° to about 540° C.) for a residence time up to about 30 minutes to produce a vaporous stream and agglomerate particles containing a residual portion of said crude oil and said finely divided carbonaceous solids;

(c) separating said agglomerate particles into a product portion having a desired particle size and a recycle portion;

(d) grinding said recycle portion to produce said finely divided carbonaceous solids;

(e) heating said finely divided carbonaceous solids prior to charging to said rotary kiln to a temperature sufficient to result in a temperature from about 850° to about 1000° F. (about 450° to about 540° C.) in said rotary kiln upon mixing said finely divided carbonaceous solids and said crude oil;

(f) mixing said finely divided carbonaceous solids and said crude oil feed stock, said finely divided carbonaceous having been separated as agglomerate particles into a recycle portion and ground into finely divided carbonaceous solids and heated prior to being mixed with said heavy crude oil feed stock.

* * * * *